US007950753B2

(12) United States Patent
Liang

(10) Patent No.: US 7,950,753 B2
(45) Date of Patent: May 31, 2011

(54) TOOL-FREE RAPID ASSEMBLY/DISASSEMBLY SLIDE RAIL DEVICE

(75) Inventor: Chien-Fa Liang, Chung-Ho (TW)

(73) Assignee: Ablecom Technology Incorporation, Chung-Ho, Taipei County (TW)

( * ) Notice: Subject to any disclaimer, the term of this patent is extended or adjusted under 35 U.S.C. 154(b) by 168 days.

(21) Appl. No.: 12/146,057

(22) Filed: Jun. 25, 2008

(65) Prior Publication Data

US 2010/0194252 A1 Aug. 5, 2010

(51) Int. Cl.
*A47B 88/00* (2006.01)

(52) U.S. Cl. ..... 312/334.4; 211/26

(58) Field of Classification Search ..... 312/330.1, 312/334.4, 334.5, 333, 351, 265.4; 211/26, 211/190, 192; 361/605, 679.02; 248/220.21, 248/221.11, 243, 244
See application file for complete search history.

(56) References Cited

U.S. PATENT DOCUMENTS

| | | | | |
|---|---|---|---|---|
| 5,833,337 | A * | 11/1998 | Kofstad | 312/334.5 |
| 6,230,903 | B1 * | 5/2001 | Abbott | 211/26 |
| 6,948,691 | B2 * | 9/2005 | Brock et al. | 248/222.13 |
| 6,974,037 | B2 * | 12/2005 | Haney | 211/26 |
| 7,284,672 | B2 * | 10/2007 | Tsai | 211/208 |
| 7,703,734 | B2 * | 4/2010 | Chen et al. | 248/298.1 |
| 7,740,329 | B2 * | 6/2010 | Hsiung et al. | 312/334.4 |
| 2004/0108427 | A1 * | 6/2004 | Chen et al. | 248/244 |
| 2005/0285493 | A1 * | 12/2005 | Hu et al. | 312/334.4 |
| 2006/0152115 | A1 * | 7/2006 | Dubon et al. | 312/334.8 |
| 2007/0235402 | A1 * | 10/2007 | Chen et al. | 211/192 |

* cited by examiner

*Primary Examiner* — James O Hansen
(74) *Attorney, Agent, or Firm* — Jackson IPG PLLC; Demian K. Jackson

(57) ABSTRACT

A tool-free rapid assembly/disassembly slide rail device is characterized in that each of a front slide rail and a rear slide rail has an end inserted by rectangular or circular flange positioning blocks of a positioning element and is detachably assembled with a resilient retaining element, wherein the positioning element is retained by the resilient retaining element to allow rapid assembly and disassembly of the slide rail device.

2 Claims, 4 Drawing Sheets

TOOL-FREE RAPID ASSEMBLY/DISASSEMBLY SLIDE RAIL DEVICE

BACKGROUND OF THE INVENTION

1. Technical Field

The present invention relates to a slide rail device, and more particularly, to a tool-free rapid assembly/disassembly slide rail device for an industrial computer, wherein each of a front slide rail and a rear slide rail has an end inserted by rectangular or circular flange positioning blocks of a positioning element and is detachably assembled with a resilient retaining element, so that the positioning element is retained by the resilient retaining element to allow rapid assembly and disassembly of the slide rail device.

2. Description of Related Art

Conventional slide rails for computer equipment or, more particularly, an industrial computer comprise a set of length-adjustable inner and outer slide rails, each having a bent section formed at an outer end thereof. The slide rails are fixed on a front slide rail post and a rear slide rail post of a computer chassis, respectively, via the bent sections. In addition, the inner slide rail has an inner side formed with a slide groove for receiving a corresponding one of slide plates fixed bilaterally on the industrial computer or a host of related equipment, so that the industrial computer or the host can be slid into and drawn out of the computer chassis along the slide rails.

The conventional slide rails for use with computer equipment are fixed on the two slide rail posts of the computer chassis by placing the bent sections adjacent to the slide rail posts and then using screws and nuts to secure the slide rails onto the posts. Therefore, assembly and disassembly of such slide rails is a time-consuming and laborious operation that cannot be done without tools.

BRIEF SUMMARY OF THE INVENTION

A primary objective of the present invention is to provide a tool-free rapid assembly/disassembly slide rail device characterized in that a user can assemble and disassemble the slide rail device rapidly without using tools.

A secondary objective of the present invention is to provide a tool-free rapid assembly/disassembly slide rail device adaptive to slide rail posts having rectangular as well as circular positioning holes.

To achieve these objectives, the present invention provides a slide rail device for computer equipment, and more particularly, a tool-free rapid assembly/disassembly slide rail device characterized in that each of a front slide rail and a rear slide rail has an end formed with a bent positioning portion inserted by rectangular or circular flange positioning blocks of a positioning element, and each of the front and rear slide rails further has a slot formed adjacent to the corresponding bent positioning portion, wherein the slot is detachably assembled with a resilient retaining element. The rectangular or circular flange positioning blocks are inserted in positioning holes on slide rail posts of a chassis and retained in place by the resilient retaining element, thereby allowing the slide rail device to be rapidly assembled to and disassembled from the slide rail posts without using tools.

BRIEF DESCRIPTION OF THE SEVERAL VIEWS OF THE DRAWINGS

The invention as well as a preferred mode of use, further objectives and advantages thereof will best be understood by reference to the following detailed description of an illustrative embodiment when read in conjunction with the accompanying drawings, wherein.

DETAILED DESCRIPTION OF THE INVENTION

Figure 1:
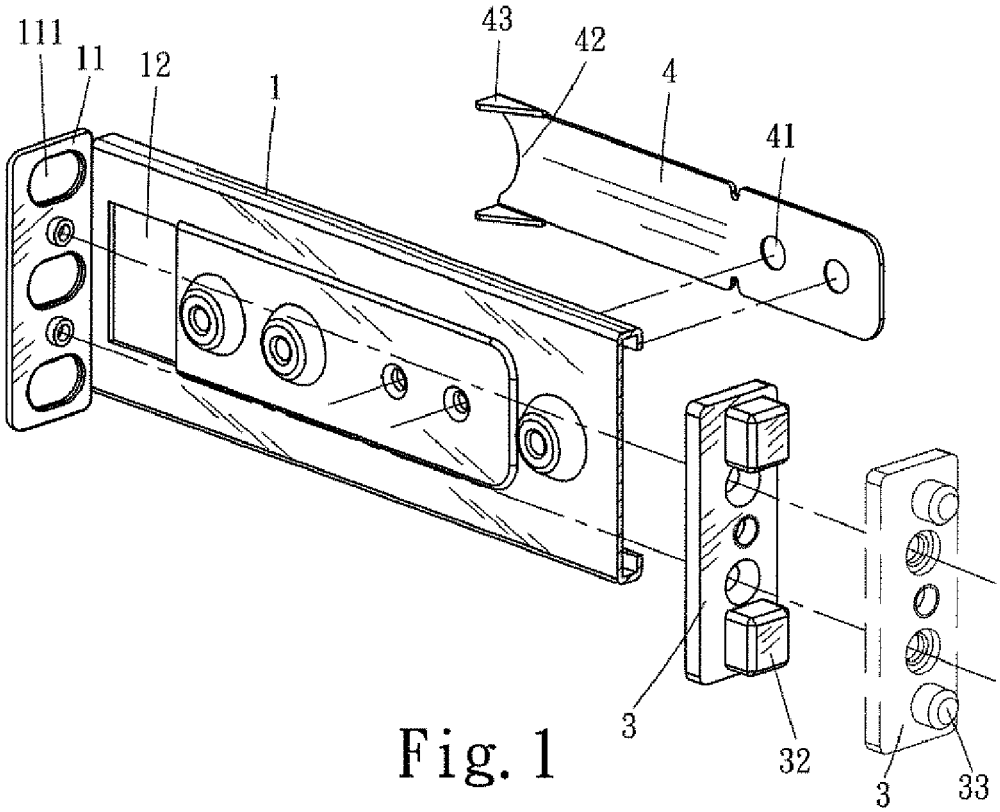
FIG. 1 is an exploded perspective view of a front slide rail according to an embodiment of the present invention.
Figure 2:
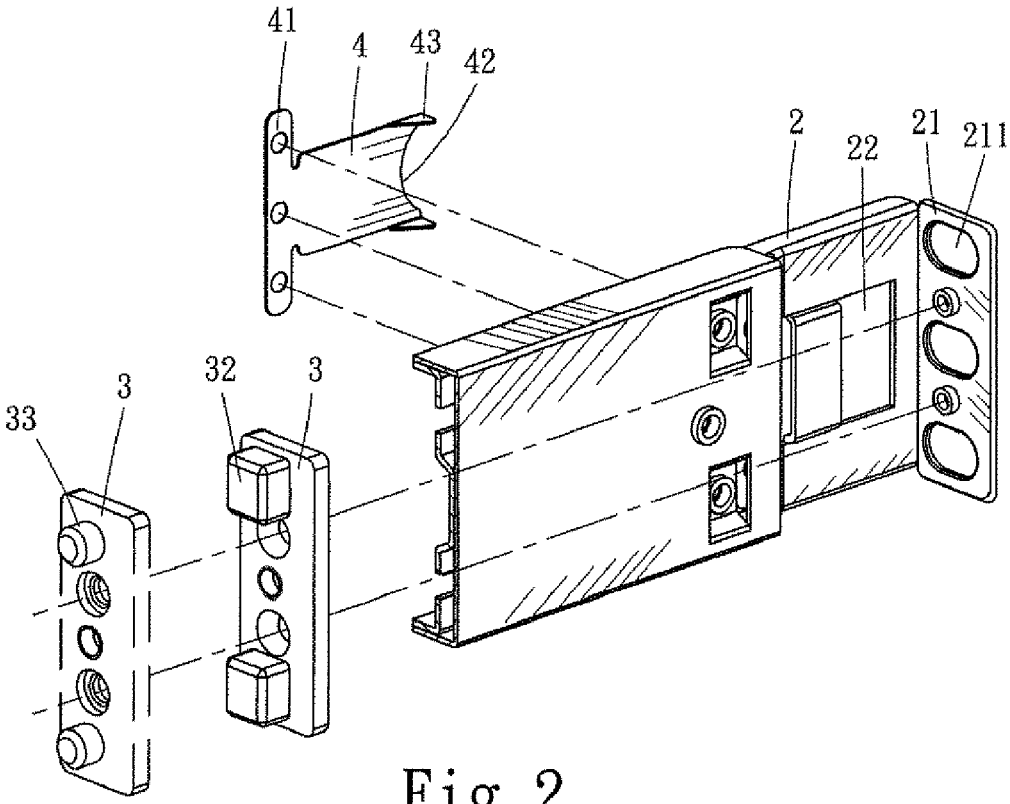
FIG. 2 is an exploded perspective view of a rear slide rail according to the embodiment of the present invention.
Figure 3:
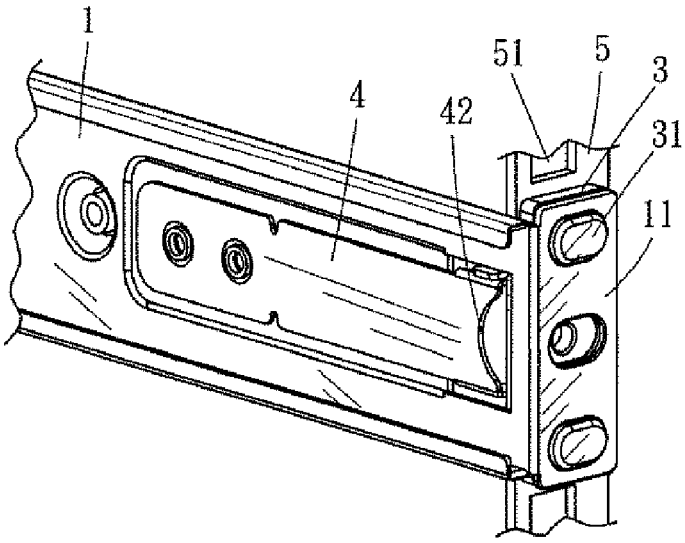
FIG. 3 is a perspective view showing the front slide rail of the present invention connected to a slide rail post having rectangular positioning holes.
Figure 4:
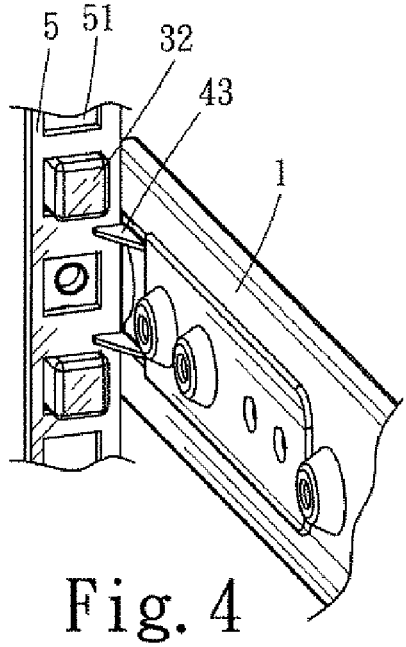
FIG. 4 is another perspective view showing the front slide rail of the present invention connected to the slide rail post having rectangular positioning holes.
Figure 5:
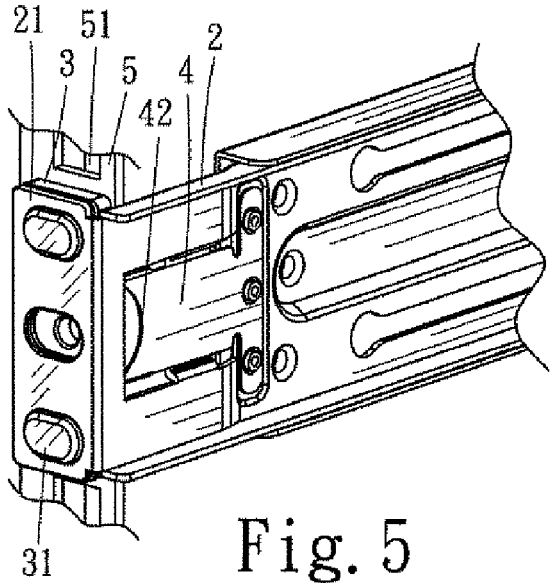
FIG. 5 is a perspective view showing the rear slide rail of the present invention connected to the slide rail post having the rectangular positioning holes.
Figure 6:
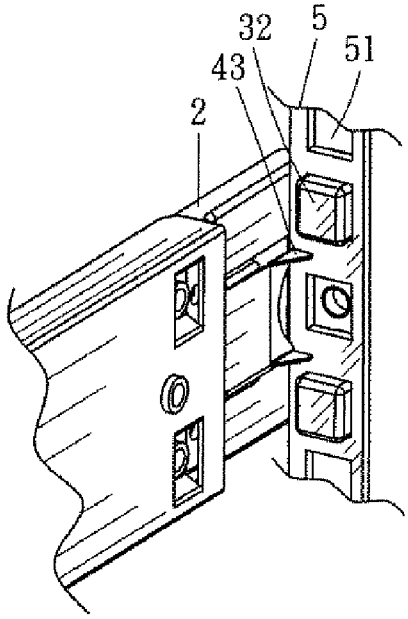
FIG. 6 is another perspective view showing the rear slide rail of the present invention connected to the slide rail post having the rectangular positioning holes.
Figure 7:
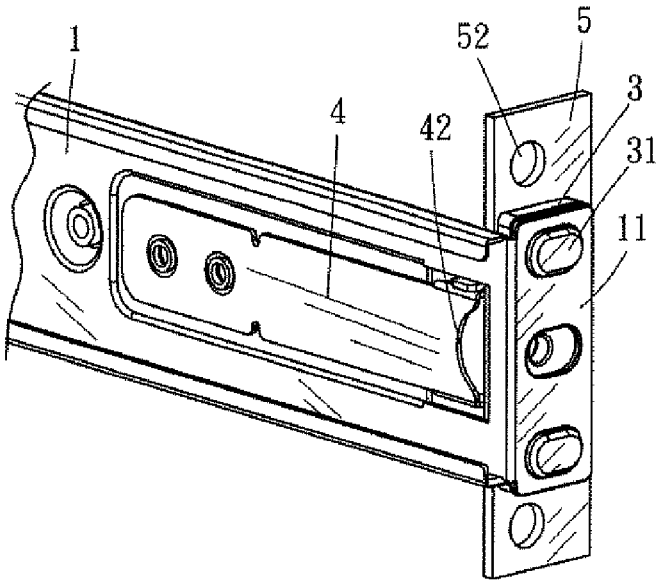
FIG. 7 is a perspective view showing the front slide rail of the present invention connected to a slide rail post having circular positioning holes.
Figure 8:
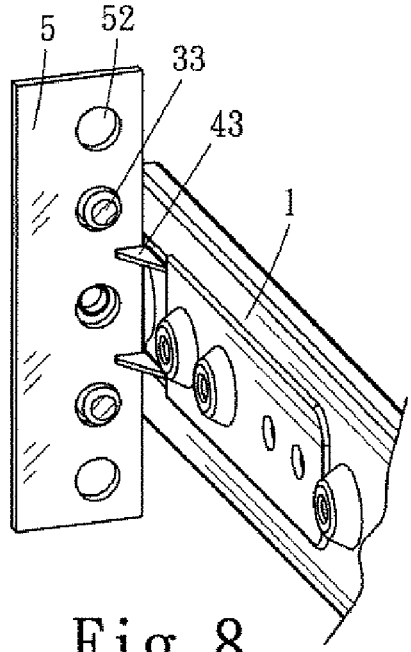
FIG. 8 is another perspective view showing the front slide rail of the present invention connected to the slide rail post having the circular positioning holes.
Figure 9:
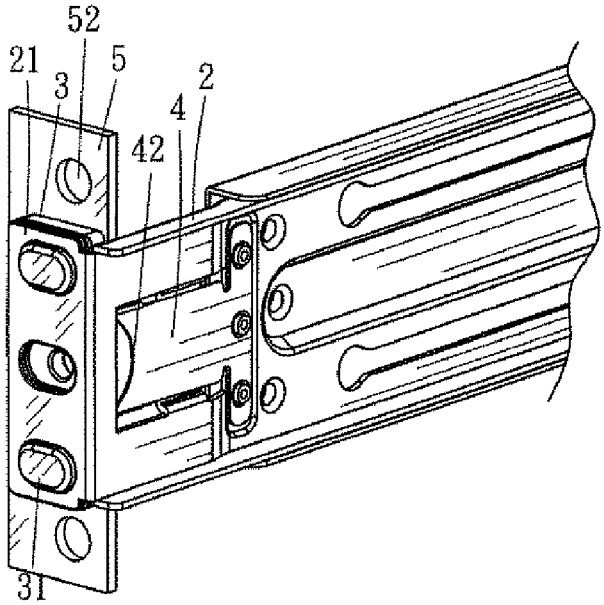
FIG. 9 is a perspective view showing the rear slide rail of the present invention connected to the slide rail post having the circular positioning holes.
Figure 10:
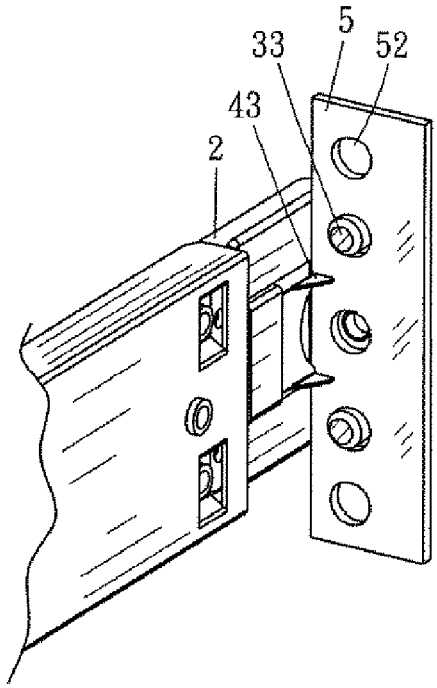
FIG. 10 is another perspective view showing the front slide rail of the present invention connected to the slide rail post having the circular positioning holes.

Referring to FIGS. 1 and 2, a tool-free rapid assembly/disassembly slide rail device according to the present invention comprises a front slide rail 1, a rear slide rail 2, two positioning elements 3 and two resilient retaining elements 4.

The front slide rail 1 has an end formed with a bent positioning portion 11. Likewise, the rear slide rail 2 has an end formed with a bent positioning portion 21. The bent positioning portions 11 and 21 are formed respectively with receiving holes 111 and 211. In addition, the front and rear slide rails 1 and 2 are provided respectively with slots 12 and 22 adjacent to the corresponding bent positioning portions 11 and 21.

Each of the positioning elements 3 has a first side provided with protrusions 31 corresponding to the receiving holes 111 and 211 on the bent positioning portions 11 and 21 of the front and rear slide rails 1 and 2, and a second side provided with rectangular flange positioning blocks 32 or circular flange positioning blocks 33 corresponding respectively to rectangular positioning holes 51 or circular positioning holes 52 formed on slide rail posts 5 of a chassis.

Each of the resilient retaining elements 4 is formed with fixing holes 41, a pulling surface 42 at an end of each of the resilient retaining elements 4, and inward-extending retainers 43. The retainers 43 can be fixed in place at an end of, and inward of, each of the slots 12 and 22 of the front and rear slide rails 1 and 2 by rivets or screws which pass through the fixing holes 41.

Referring to FIGS. 3 to 10, in order to assemble the slide rail device to the slide rail posts 5 of the chassis, a user has to first determine whether the slide rail posts 5 have the rectangular positioning holes 51 or the circular positioning holes 52, and then choose the corresponding positioning elements 3 having the rectangular flange positioning blocks 32 or the circular flange positioning blocks 33. Next, the protrusions 31 provided on the first side of each of the positioning elements 3 are inserted into the receiving holes 111 and 211 on the respective bent positioning portions 11 and 21 of the front and real slide rails 1 and 2, thereby connecting the positioning elements 3 to the front and rear slide rails 1 and 2.

Figure 11:
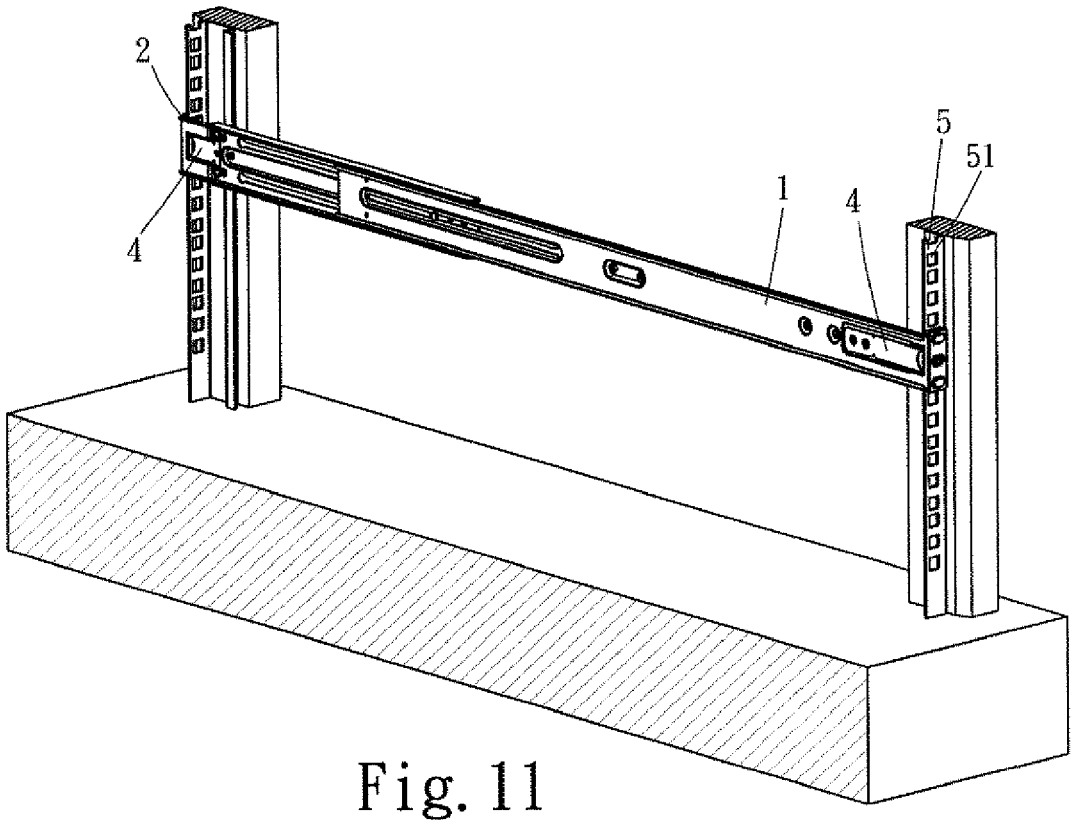
FIG. 11 is a perspective view showing the front and rear slide rails of the present invention fixed on slide rail posts having rectangular positioning holes.
Figure 12:
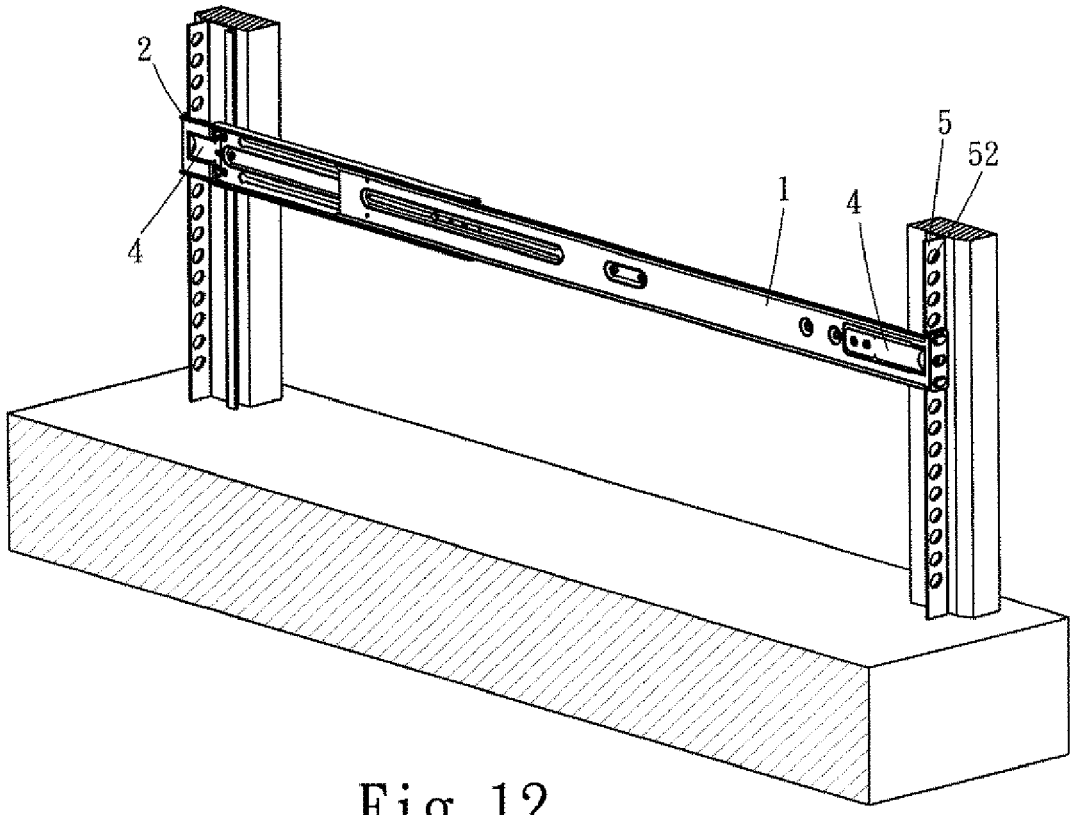
FIG. 12 is a perspective view showing the front and rear slide rails of the present invention fixed on slide rail posts having circular positioning holes.

Following that, referring to FIGS. 11 and 12, the rectangular flange positioning blocks 32 or the circular flange positioning blocks 33 of the positioning elements 3 are inserted into the rectangular positioning holes 51 or the circular positioning holes 52 of the corresponding slide rail posts 5. Then, the resilient engaging elements 4 are assembled to the front and rear slide rails 1 and 2, so as to press against and engage with inner sides of the corresponding slide rail posts 5, thus allowing the front and rear slide rails 1 and 2 and the positioning elements 3 to be rapidly secured to the corresponding slide rail posts 5.

When it is desired to detach the front and rear slide rails 1 and 2 from the slide rail posts 5, the user can do so by pulling the pulling surfaces 42 of the respective resilient engaging elements 4 outwards and detaching the retainers 43 from the slide rail posts 5, so that the front and rear slide rails 1 and 2 and the positioning elements 3 are disassembled from the slide rail posts 5. Thus, the slide rail device of the present invention can be rapidly assembled to and disassembled from an industrial computer or a host of related equipment without using any tools.

The invention claimed is:

1. A tool-free rapid assembly/disassembly slide rail device, comprising:

a front slide rail and a rear slide rail, each having an end formed with a bent positioning portion having a receiving hole thereon, and each of the front and rear slide rails further having a slot formed adjacent to the corresponding bent positioning portion;

two positioning elements, each having a first side provided with a protrusion corresponding to the receiving hole on the bent positioning portion formed at the end of each of the front and rear slide rails, and a second side provided with rectangular or circular flange positioning blocks corresponding respectively to rectangular or circular positioning holes formed on slide rail posts of a chassis, wherein the two positioning elements can be connected to the front and rear slide rails, respectively; and two resilient retaining elements, each formed with a fixing hole, a pulling surface at an end of each said resilient retaining element, and an inward-extending retainer;

wherein the retainer can be fixed in place at an end of the slot of each of the front and rear slide rails by a rivet or screw which passes through the fixing hole, so that the retainer is inward of the slot, and wherein the retainer can press against and engage with an inner side of a corresponding one of the slide rail posts when the front and rear slide rails and the positioning elements are secured in position through the rectangular or circular positioning holes on the slide rail posts, thus allowing the front and rear slide rails, and the positioning elements to be rapidly secured to the slide rail posts.

2. The tool-free rapid assembly/disassembly slide rail device as claimed in claim 1, wherein there are two types of said positioning elements: a first type of the positioning elements being provided on the respective second sides thereof with rectangular flange positioning blocks shaped according to the rectangular positioning holes on the slide rail posts; and a second type of the positioning elements being provided on the respective second sides thereof with circular flange positioning blocks shaped according to the circular positioning holes on the slide rail posts, such that the positioning elements can be selectively used to match the rectangular or circular positioning holes on the slide rail posts.

* * * * *